United States Patent [19]

Tonkiss

[11] Patent Number: 4,934,416

[45] Date of Patent: Jun. 19, 1990

[54] POWER-OPERATED BANDING TOOL

[75] Inventor: David W. Tonkiss, Glendale, Calif.

[73] Assignee: Joslyn Corporation, Chicago, Ill.

[21] Appl. No.: 277,325

[22] Filed: Nov. 29, 1988

[51] Int. Cl.[5] ..... B21F 9/02

[52] U.S. Cl. ..... 140/93.2; 140/123.6; 140/152

[58] Field of Search ..... 140/93 A, 93.2, 93.4, 140/123.6, 150, 152; 464/104

[56] References Cited

U.S. PATENT DOCUMENTS

| | | | |
|---|---|---|---|
| 2,007,002 | 7/1935 | Porter | 140/93.4 |
| 3,319,666 | 5/1967 | Langford et al. | 140/93.2 |
| 3,404,545 | 10/1968 | Walker | 464/104 |
| 4,610,067 | 9/1986 | Hara | 140/93.2 |
| 4,726,403 | 2/1988 | Young et al. | 140/123.6 |

*Primary Examiner*—Lowell A. Larson
*Attorney, Agent, or Firm*—Mason, Kolehmainen, Rathburn & Wyss

[57] ABSTRACT

A power driven banding tool utilizes, for example, a pneumatic motor, electric motor or other means of motive power for progressively driving the band through the tool. The tool is provided with a rotary drive mechanism which includes a knurled wheel and a plurality of spring loaded pinch rollers for gripping the band. The driving torque for the knurled wheel is provided by a worm gear assembly by way of an adjustable clutch. The worm gear assembly is operatively connected to a pneumatic or electric motor. The adjustable clutch allows the pull pressure to be calibrated to the desired limits. An Oldham type coupling is provided between the motor output shaft and the worm gear input shaft to overcome any axial misalignment. The tool also includes a handle operated rollover assembly for bending the band around the buckle to maintain the tension in the band so it can be cut off. A cut off assembly is operatively coupled to the pivotally mounted handle for actuating a cut off blade in the front of the tool to cut the band. A final trim assembly is further provided in the chin of the tool to trim the excess band flush with the top of the buckle.

50 Claims, 9 Drawing Sheets

POWER-OPERATED BANDING TOOL

BACKGROUND OF THE INVENTION

1. Field of the Invention

The invention relates to a banding tool and more particularly to a power driven banding tool for terminating an electromagnetic shielding sleeve, such as a woven metal braid, used to shield electrical conductors from electromagnetic and radio frequency interference, to an electrical cable connector housing or the like.

2. Background of the Invention

Electrical cables having a plurality of electrical conductors are often provided with a woven metal braid for shielding the conductors from electromagnetic and radio frequency interference. The conductors within the electrical cable are terminated at electrical terminals provided within an electrical connector. The shielding sleeve is terminated to the connector housing. In order to provide a mechanically secure and low resistance connection between the shielding sleeve and the connector housing, a clamping band is used. More particularly, the shielding sleeve is disposed about the outside surface of an extending neck portion of the connector housing. The clamping band is then placed over the shielding sleeve and tightened down about the extending neck portion. A buckle is then used to secure the tension in the clamping band.

Various tools are known in the art for tightening and securing a clamping band to a connector housing. For example, U.S. Pat. Nos. 4,688,607 and 4,726,403 disclose manually operated banding tools. These banding tools are provided with gripper mechanisms for incrementally pulling the band along a drive track to tighten the band and secure it to a connector housing. A pivotally mounted handle is operatively connected to the gripper mechanism. Pivotal operation of the handle causes the clamping band to be incrementally pulled along the drive track by the gripper mechanism. A supplemental grip holds the band in position when the gripper mechanism releases the band and regrips the band at a different position. The process is repeated until the band is secure around the connecting sleeve. The band is then rolled over the buckle to retain the tension in the band and subsequently cut and trimmed by one or more different tools to complete the termination.

The banding tools disclosed in the abovementioned prior art are manually operated and incrementally advance the band through the tool. Accordingly, the time and labor cost for tightening and securing the band about the connector housing are relatively high. Moreover, since the various operations are performed with separate tools, this further increases the time and cost.

SUMMARY OF THE INVENTION

It is an object of the present invention to provide a banding tool which overcomes the problems associated with the prior art.

It is another object of the invention to provide a power operated banding tool.

It is a further object of the present invention to provide a banding tool which progressively advances the band through the tool.

It is yet another object of the present invention to provide a banding tool which reduces the time and labor cost for tightening and securing a band about a connector housing.

It is another object of the present invention to provide a tool, capable of performing all operations necessary to complete the termination.

Briefly, the present invention relates to a power driven banding tool which utilizes, for example, a pneumatic motor, electric motor or other means of motive power for progressively driving the band through the tool. The tool is provided with a rotary drive mechanism which includes a knurled wheel and a plurality of spring loaded pinch rollers for gripping the band. The driving torque for the knurled wheel is provided by a worm gear assembly by way of an adjustable clutch. The worm gear assembly is operatively connected to a pneumatic or electric motor. The adjustable clutch allows the pull pressure to be calibrated to the desired limits. An Oldham type coupling is provided between the motor output shaft and the worm gear input shaft to overcome any axial misalignment. The tool also includes a handle operated rollover assembly for bending the band around the buckle to maintain the tension in the band so it can be cut off. A cut off assembly is operatively coupled to the pivotally mounted handle for actuating a cut off blade in the front of the tool to cut the band. A final trim assembly is further provided in the chin of the tool to trim the excess band extending outwardly from the buckle.

DESCRIPTION OF THE DRAWING

The objects and advantages of the invention will be apparent from the following description and the accompanying drawing wherein.

DETAILED DESCRIPTION

Figure 1:
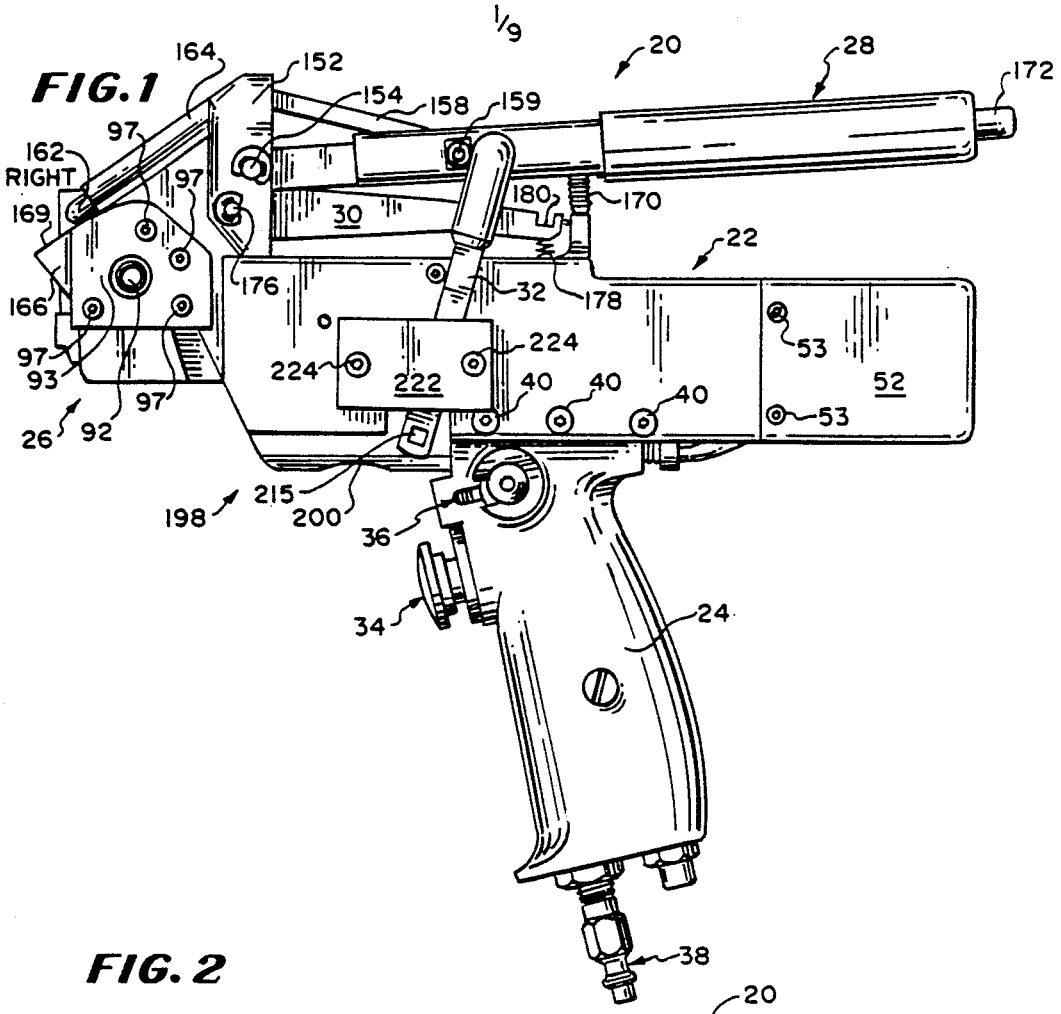
FIG. 1 is a right side elevational view of the banding tool in accordance with the present invention.

The tool in accordance with the present invention is generally used to terminate an electrical cable shielding sleeve 16 about a connector housing 17 with a clamping band 18 having an integrally formed buckle portion as disclosed in U.S. Pat. No. 4,751,769, assigned to the same assignee as the present invention, and hereby incorporated by reference.

As will be understood by those of ordinary skill in the art, the particular type of band is not critical to the practice of the invention. Accordingly, various types of bands may be used with the tool in accordance with the invention in addition to the particular band referenced above. For example, the bands, such as disclosed in U.S. Pat. No. 4,646,393, may be used. Also, a continuous web of band material may be used. All such types of bands are contemplated for use with the present invention.

As herein described, a pneumatic tool 20 will be described and illustrated. However, it should be understood that the principles of the present invention are also applicable to electrically operated tools and other power operated tools as well. Moreover, it should also be understood that the principles of the present invention are also applicable to any type of banding tool and are not limited to banding tools for securing a clamping band around a connector housing or the like.

The tool 20 includes a housing 22 having a handle portion 24, a nose portion 26. A rollover handle 28 is pivotally connected to the housing 22 for bending the band 18 around a buckle 19 to secure the tension in the band 18 before it is cut. A cut off actuator arm 30 is pivotally connected to the top of the housing 22 for cutting the band 18. A final trim lever 32 is pivotally connected to the side of the housing 22 to allow the band 18 to be sheared close to the buckle 19.

A trigger 34 is provided on the handle portion 24 for actuating the tool 20. A reversing switch 36 is also provided on the handle portion 24 of the tool 20 to allow the direction of the pneumatic or electric motor to be reversed. A pneumatic connector 38 is provided on the bottom of the handle portion 24 to allow connection to an external source of compressed air (not shown). In an embodiment utilizing an electric motor instead of a pneumatic motor, the pneumatic connector would be replaced with a power cord for AC motors or an electrical connector for a DC motor having rechargeable batteries disposed in the handle portion 24.

The handle portion 24 is fastened to the housing 22 with a plurality of fasteners 40. A fourway slide valve (not shown) is provided in an upper section of the handle portion 24 for allowing an air motor 42 to be reversed. More particularly, the air motor 42 is of the reversible type which allows the direction of rotation of its output shaft 43 to be reversed by switching the connections to the inlet and output ports by way of the four-way slide valve. The air motor 42 must have sufficient power and speed to achieve the necessary pull pressure on the band 18 and to feed the band 18 through the tool 20 relatively quickly.

Figures 4, 5, 6:
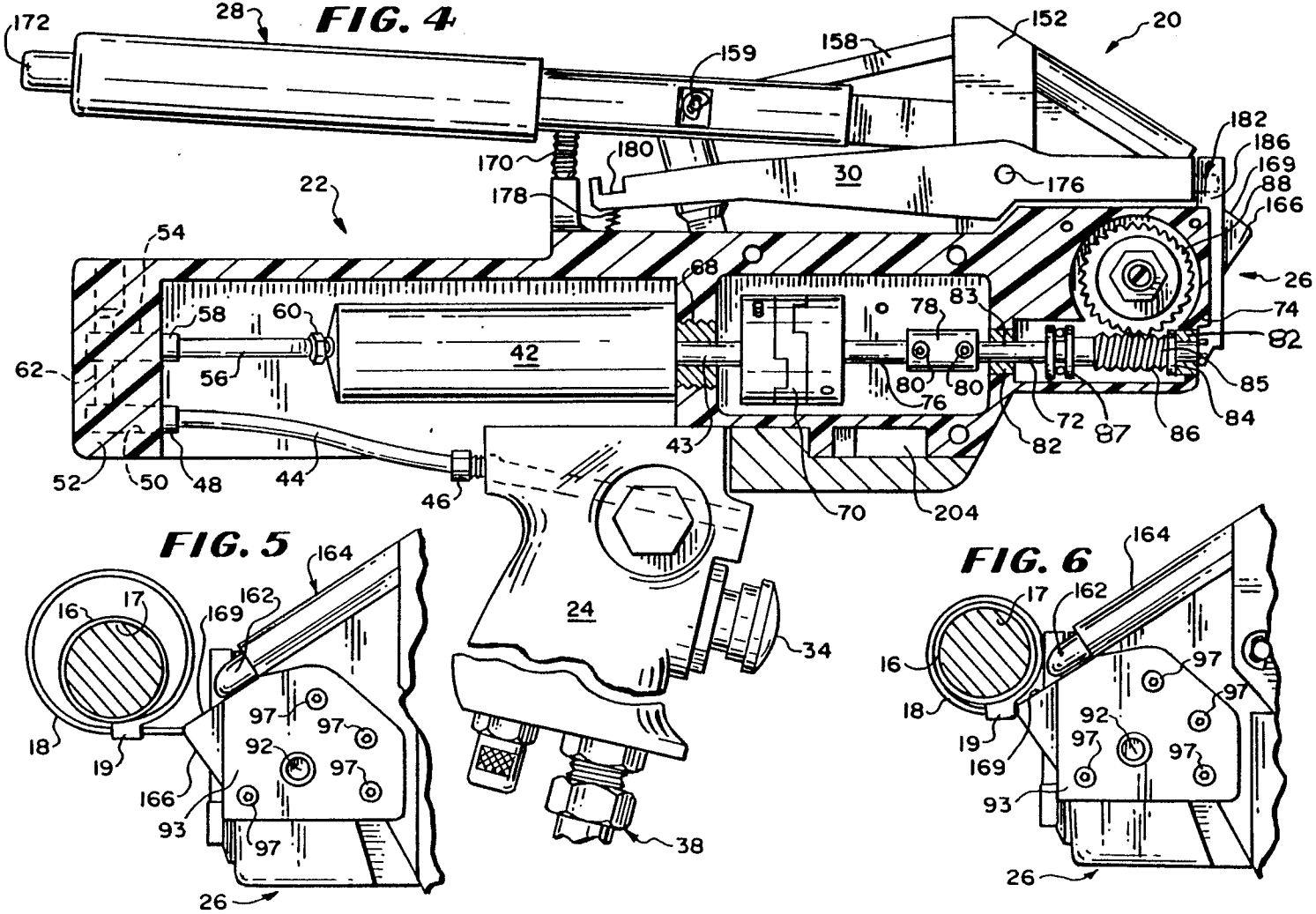
FIG. 4 is a sectional view of the tool in accordance with the present invention.
FIG. 5 is a partial side elevational view of the front portion of the tool showing a band disposed about a connector housing in an intermediate stage.
FIG. 6 is similar to FIG. 5 and shows the band tightened against the connector housing.
Figure 7:
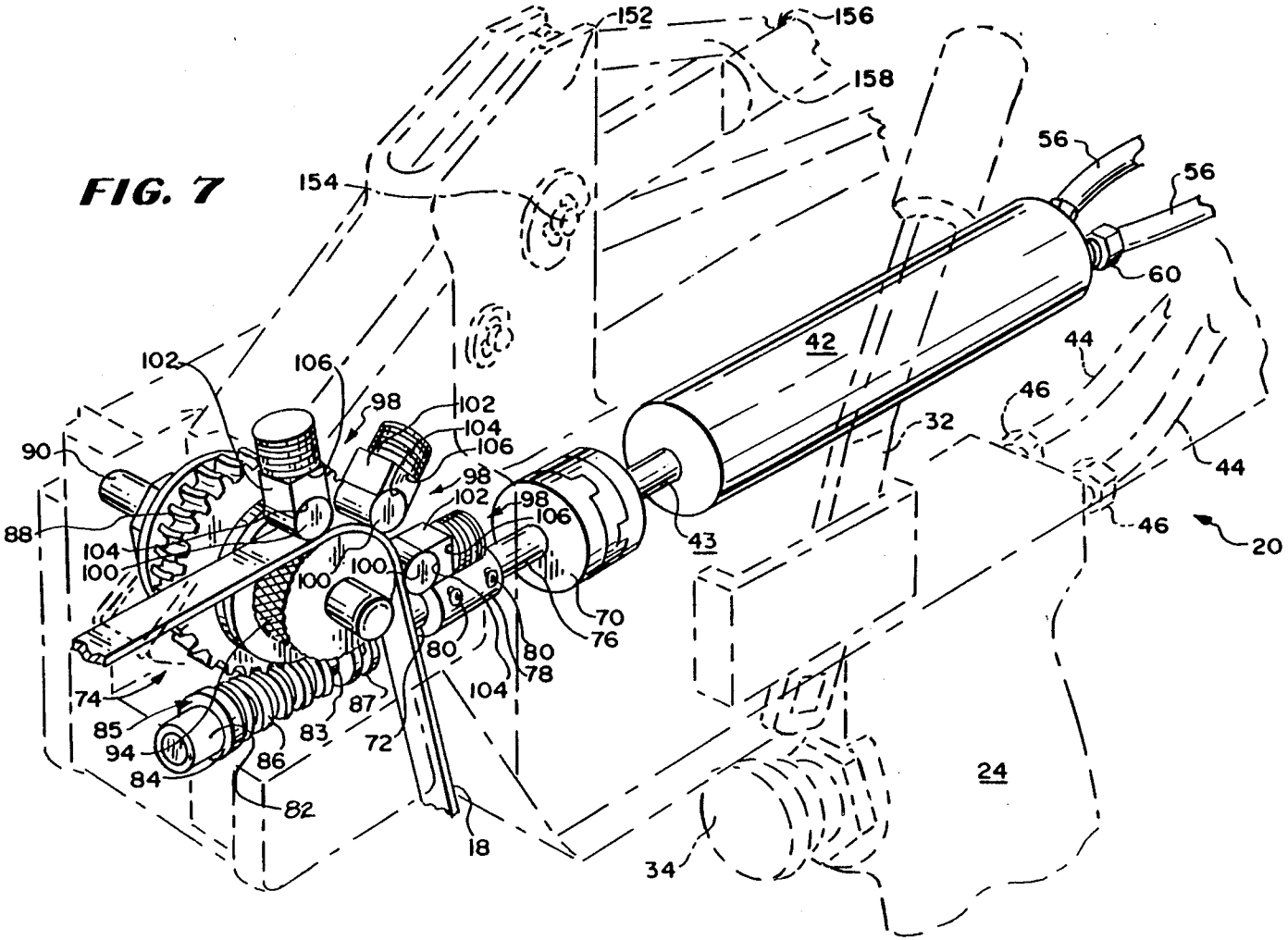
FIG. 7 is a perspective view of the interior portion of the tool.

As best shown in FIG. 4, the inlet and outlet ports from the slide valve are connected to a pair of conduits 44 by appropriate pneumatic connectors 46. The other end of each of the conduits 44 is provided with an O-ring plug 48, received in a pair of lower bores 50 provided in a rear cap 52. The rear cap 52 forms a portion of the housing 22 and is connected thereto with a plurality of fasteners 53. A pair of upper bores 54 is provided in the rear cap 52 for receiving inlet and outlet conduits 56, connected to the air motor 42. The conduits 56 are provided with O-ring plugs 58 at one end. The O-ring plugs 58 are received in the upper bores 54. The other end of the conduits 56 are provided with connectors 60, attached to the air motor 44. The rear cap 52 is cross-drilled to provide a passageway 62 between the upper bores 54 and the lower bores 50 and plugged flush with the exterior top surface of the rear cap 52. The passageway 62 allows compressed air to flow between the handle portion 24 and the air motor 42.

The air motor output shaft 43 is supported by a threaded portion 68 of the pneumatic motor body, carried by an interior portion of the housing 22. An Oldham type coupling 70 is coupled between the air motor output shaft 43 and an input shaft 72 to a worm gear assembly 74 to overcome any axial misalignment. An output shaft 76 from the Oldham coupling 74 is coupled to the input shaft 72 to the worm gear assembly 74 by way of a rigid coupling 78. The Oldham coupling output shaft 76 and the worm gear assembly input shaft 72 are secured to the rigid coupling 78 by way of set screws 80.

The worm gear assembly 74 includes a driving worm 86 and a worm gear 88. The worm gear assembly input shaft 72 is supported by journal bearings 82 on both ends. A thrust bearing 87 is provided on the input shaft 72 to defray friction encountered when operating the tool 20 in the forward mode. The distal end 85 of the input shaft 72 is supported by a thrust bearing 84 as well as the journal bearing 82, carried by the nose portion 26.

The worm gear 88 is rotatably carried by a worm gear assembly output shaft 90. The ends 92 of the output shaft 90 are journalled in a right nosepiece 93 and a left nosepiece 95, which form a portion of the nose portion 26. The right nosepiece 93 and the left nosepiece 95 are connected to the housing 22 with a plurality of fasteners 97.

The left nosepiece 95 is generally formed as a plate member having an extending sleeve (not shown) which provides a bearing surface for the center portion of the worm gear shaft 90. As will be discussed in detail below, the right nosepiece 93 carries a plurality of pinch roller assemblies 98.

A knurled wheel 94 and an adjustable clutch assembly 96 are disposed about the worm gear output shaft 90. The knurled wheel 94 is keyed to the worm gear output shaft 90 to cause the knurled wheel 94 to rotate therewith. The adjustable clutch assembly 96 allows the pulling torque to be adjusted to desired limits as will be discussed in more detail below.

An important aspect of the invention relates to the ability of the tool 20 to grip the band 18 such that it can be progressively fed through the tool. The pinching or gripping action is provided by a rotary drive mechanism, which includes the knurled wheel 94 held in contact with a series of pinch roller assemblies 98. The pinch roller assemblies 98 are disposed concentrically about the knurled wheel 94 along an arc of approximately 105°. The self-locking characteristic of the worm gear assembly 74 prevents the rotary drive mechanism from slipping.

The pinch roller assemblies 98 are spring loaded to apply pressure to the rollers as the band 18 is fed through the tool 20. The spring constant is such that it has a zero preload (e.g., when there is no band 18 in the tool). The band 18 is disposed between the pinch roller assemblies 98 and a knurled wheel 94. Upon displacement of the pinch roller assembly 98 by a band 18 being driven through the tool 20, sufficient spring pressure is developed to impress the knurl pattern of the knurled wheel 94 into the band 18 to grip the band and prevent it from slipping when the calibrated pulling pressure is achieved.

Figure 8:
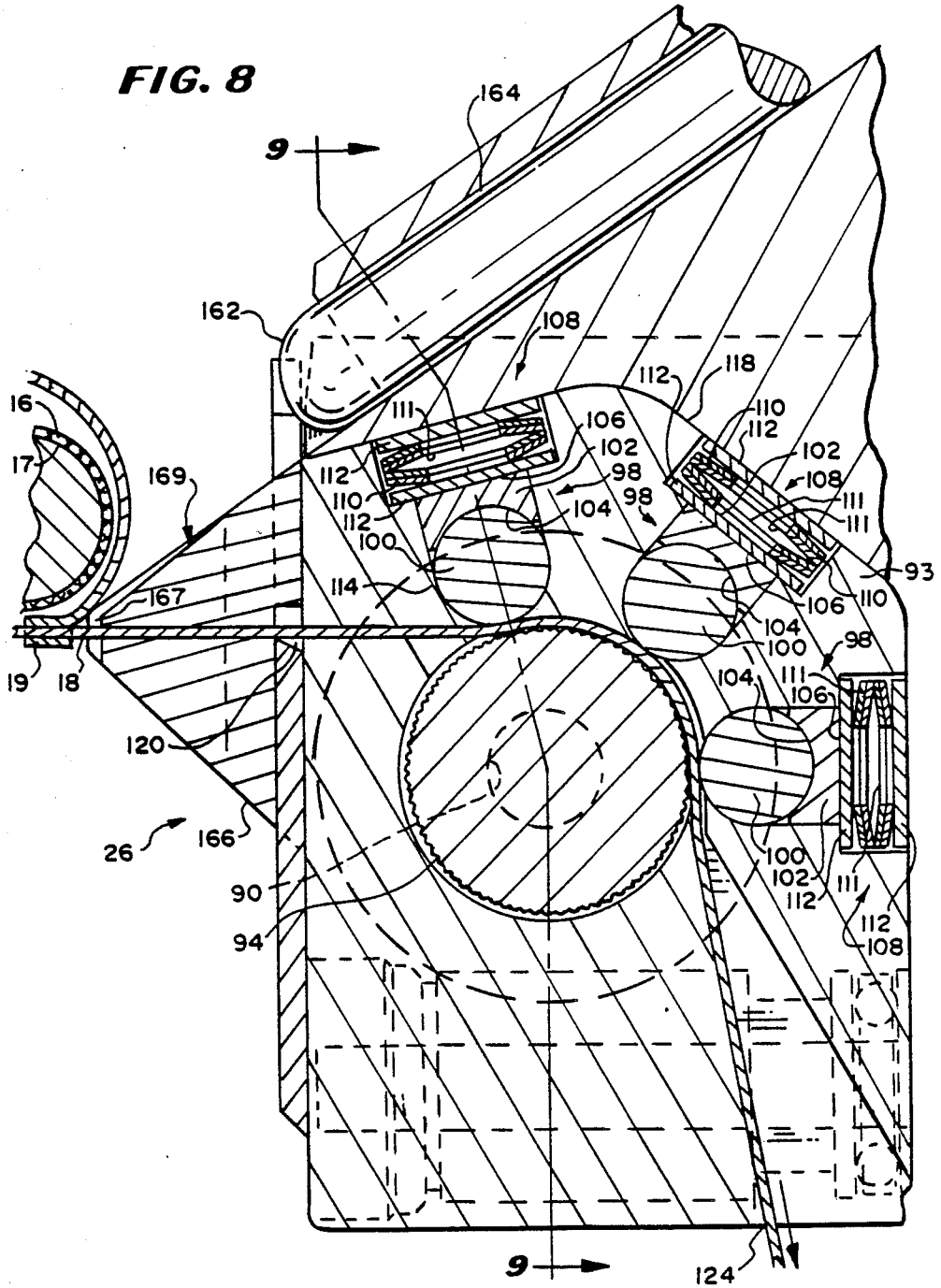
FIG. 8 is a partial sectional view of the front portion of the tool in accordance with the present invention.
Figure 9:
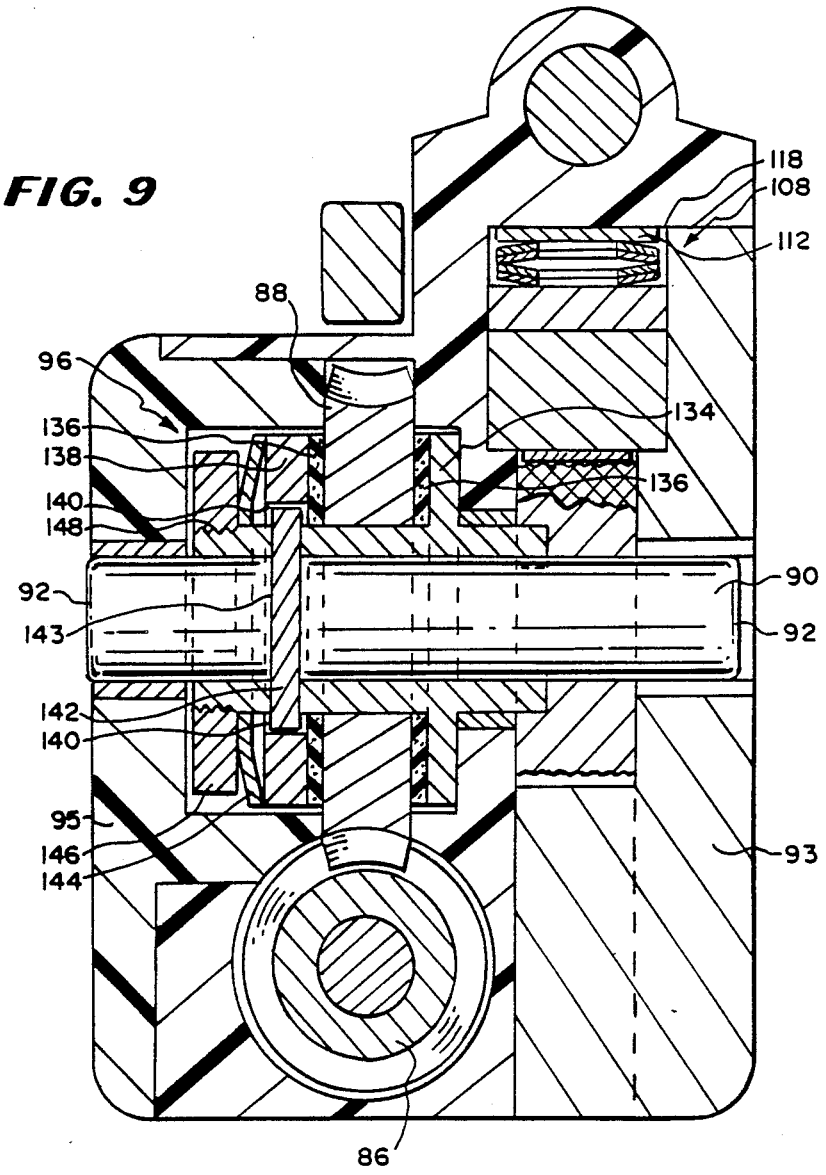
FIG. 9 is an offset sectional view along line 9—9 of FIG. 8.

The pinch roller assemblies 98 include a cylindrically shaped roller 100, rotatably carried by a roller bearing 102. The roller bearing 102 is formed from a rectangular shaped member having a concave surface 104 on one side, which provides the bearing surface for the roller 100. A flat side surface 106 of the roller bearing 102 is used as a bearing surface for a spring assembly 108. Each spring assembly 108 is formed from a plurality of Belleville washers 110, stacked one on top of the other such that the cup portions 111 of the Belleville washers 110 mate as shown in FIG. 8. The Belleville washers 110 provide the spring force to bias the pinch roller assembly 98 against the knurled wheel 94. The number of Belleville washers 110 used depends on the pulling pressure of the band through the tool 20. A spring back-up/calibration plate 112 is disposed adjacent each end of the stack of Belleville washers 110 as best illustrated in FIG. 8.

The pinch roller assemblies 98 are received in cavities 114 formed in the right nosepiece 93. The spring assemblies 108 seat against an inner wall 118 of the housing 22 once the right nosepiece 93 is received in the coextensive cavity (not shown) in the housing 22.

The right nosepiece 93 is provided with a slot 120 in the nose portion 26 and a slot 124 in the bottom portion. The slots 120 and 124 define the entry and exit points, respectively, of the drive track of the band 18 through the tool 20. More particularly, the leading edge of the band 18 is fed into the front slot 120. Since there is a zero preload on the spring assembly 108, once the band 18 is fed between the pinch roller assembly 98 and the knurled wheel 94, sufficient spring pressure is developed to impress the knurl pattern of the knurled wheel 94 into the band 18 to prevent it from slipping and also to grip it while the calibrated pulling pressure is developed by the drive assembly. The band 18 is tightened about a connector housing 17 by depressing the trigger 34 on the handle portion 24 of the tool 20. Should the shielding sleeve 16 require adjustment with respect to the connector housing 17 after the band 18 has been tightened, the clamping band 18 can be loosened by reversing the direction of rotation of the air motor 44. The shielding sleeve can then be adjusted and the clamping band 18 retightened.

Another important aspect of the invention relates to the adjustable clutch assembly 96. The adjustable clutch assembly 96, disposed on the worm gear output shaft 90, allows the pull pressure to be adjusted. The adjustable clutch assembly 96 includes a pressure plate 134, rigidly secured to the worm gear output shaft 90 and disposed adjacent the worm gear 88. The pressure plate 134 is provided with a friction material 136 on the surface that engages the worm gear 88. The worm gear 88 is rotatably mounted with respect to the output shaft 90. Another pressure plate 138 is disposed on the output shaft 90 so as to sandwich the worm gear 88 between the two pressure plates 134 and 138. The surface of the pressure plate 138, that engages the worm gear 88, is also coated with a friction material 136. The pressure plate 138 is keyed to the shaft 90 so that it will not rotate with respect to the shaft 90. More particularly, the pressure plate 138 is provided with notches 140. A keeper pin 142 is disposed in a transverse bore 143 in the output shaft 90 and received in the notches 140 to register the pressure plate 138 with respect to the shaft 90.

A spring assembly 144, which may consist of one or more Belleville washers, is disposed about the shaft 90 and contacts the pressure plate 138. A locking nut 146 is received on a threaded portion 148 of the shaft 90. By adjusting the locking nut 146, the pressure exerted on the worm gear 88 by way of the spring assembly 144 (release torque) can be adjusted by controlling the pressure exerted on the worm gear 88 by the spring assembly 144. Since the worm gear is sandwiched between the pressure plates 134 and 138, the worm gear 88 will slip as a function of the pressure from the spring assembly 144 to achieve the desired pull torque through the tool 20.

Figure 10:
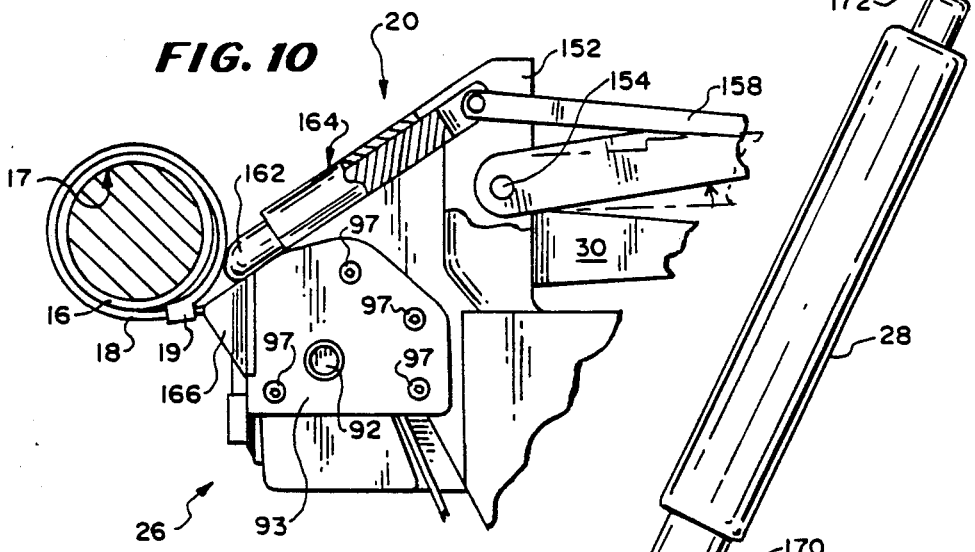
FIG. 10 is a partial side elevational view of the front portion of the tool illustrating the rollover assembly in its initial position.

Another important aspect of the tool relates to the rollover assembly 150 for bending the band 18 about the buckle 19 after it has been secured about a connector housing 17 to maintain the tension in the band 18. This operation is shown best in FIGS. 10 and 11. The roll-over assembly 150 includes a pivotally mounted handle 28. The handle 28 is pivotally mounted to an upstanding clevis 152, integrally formed as part of the housing 22, by way of a clevis pin 154. An axial slot 156 is provided intermediate the ends of the handle 28 receives a lever 158. The lever 158 pin 159. The other end of the lever 158 is pivotally connected to one end of a rollover rod 162. The roll-over rod 162 is received in a barrel type chamber 164 integrally formed in the housing 22.

Figure 11:
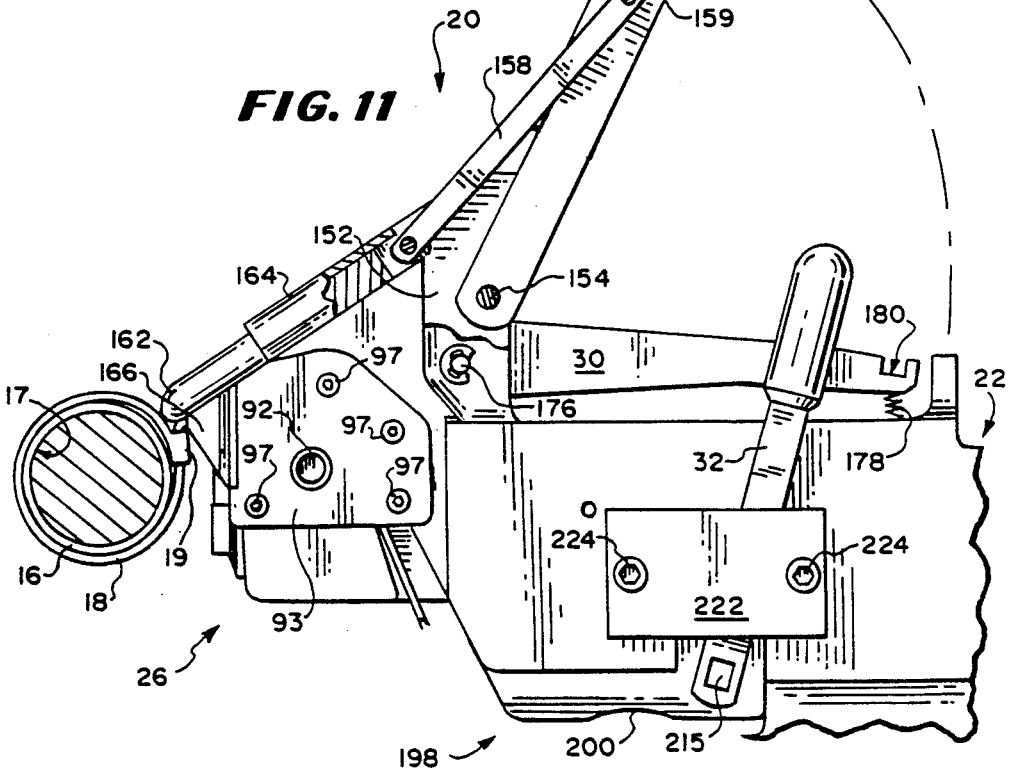
FIG. 11 is a partial sectional view, similar to FIG. 10, illustrating the rollover member bending the clamping band around the buckle.

As best shown in FIG. 11, on an upward stroke of the rollover assembly 150 (e.g., when the handle 28 is rotated in a counterclockwise direction) the rod 162 moves downwardly over a front nosepiece 166 to bend the band 18 about the buckle 19 to maintain the tension in the band 18 such that the band 18 can be cut and the termination removed from the tool 20. On the downward stroke of the handle 28, the rod 162 is retracted into the barrel type chamber 164. As shown best in FIGS. 10 and 11, the band 18 is drawn tight such that the buckle 19 becomes in contact with a front nosepiece 166.

The front nosepiece 166 is removably attached to the right nosepiece 93 and the left nosepiece 95. The front nosepiece 166 has a sloped surface 169 to allow free movement of the rollover rod 162 thereacross and to allow the buckle 19 to be disposed relatively parallel to the direction of travel of the band 18. More particularly, the sloped surface 169 engages the coiled band 18 to allow the buckle 19 to maintain a relatively parallel relationship with respect to the direction of travel of the band. The front nosepiece 166 also includes a slot 167 (FIGS. 12B and 13B) which is aligned with the slot 120 and forms a portion of the drive track for the band 18. A relief cut is provided on the underside of the front nosepiece 166, immediately adjacent the slot 167 that allows it to accept the full width of the buckle 19. The relief cut allows the band to bend adjacent the buckle 19 without distortion to the buckle 19.

Another important aspect of the present invention relates to a cutting assembly 168, for cutting the band 18 so that the termination can be removed from the tool 20.

Figures 12A, 12B, 13A, 13B:
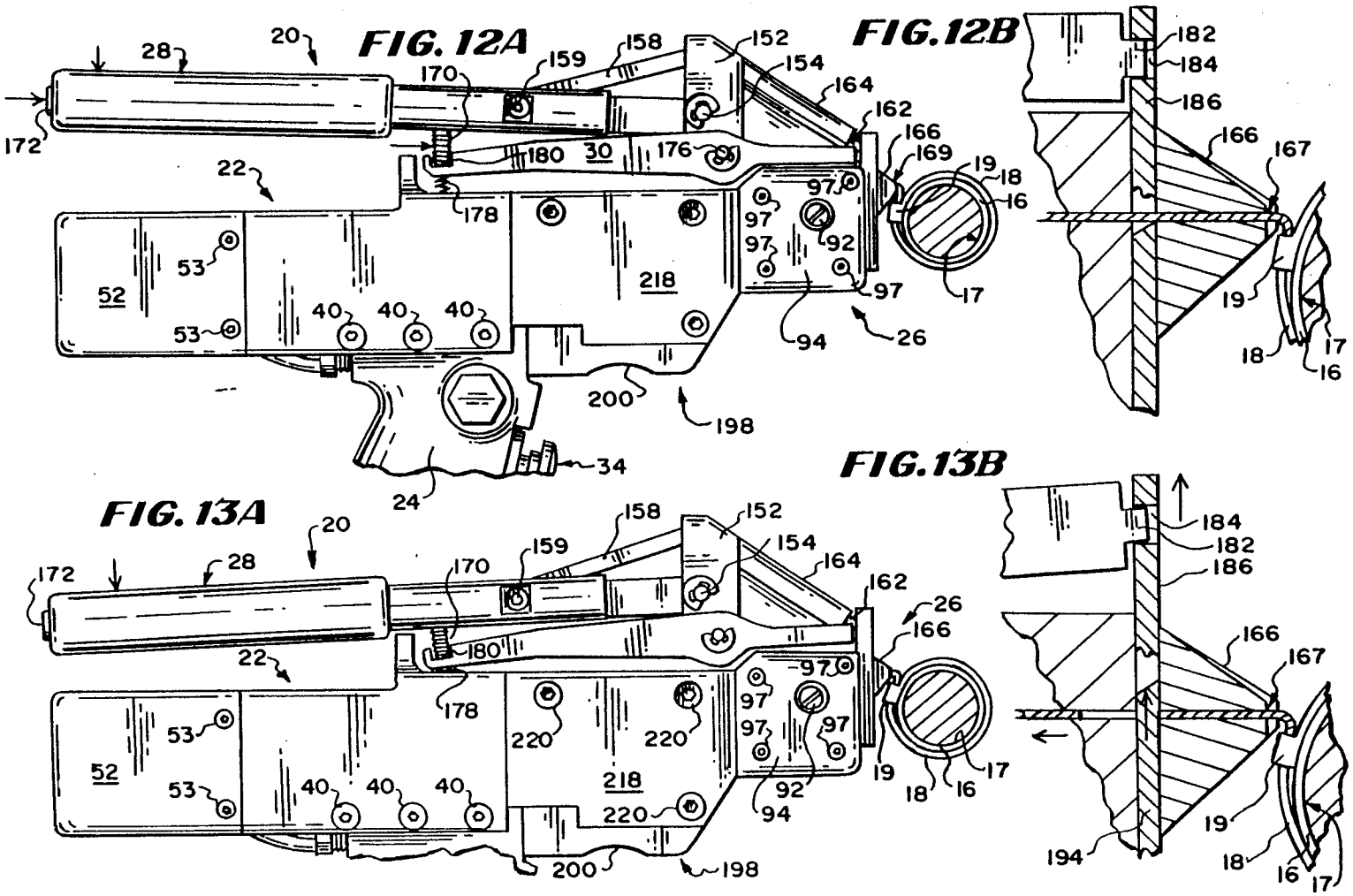
FIG. 12*a* is a partial side elevation of the tool illustrating the cut off assembly in its initial position.
FIG. 12*b* is a partial sectional view of the cut off assembly illustrated in FIG. 12*a;*
FIG. 13*a* is a partial side elevation of the tool in accordance with the present invention illustrating the cut off assembly in its cut off position.
FIG. 13*b* is a sectional view of the cut off assembly, similar to FIG. 13*a;*

This is best shown in FIGS. 12*a*, 12*b*, 13*a* and 13*b*. FIGS. 12*a* and 12*b* show the position of the cutting assembly 168 prior to a cut. FIGS. 13*a* and 13*b* show the tool just after the cut.

The cutting assembly 168 includes a cut off arm 30 and a cut off boss 170. The cutoff boss 170 is rigidly attached at approximately a 90° angle to a rod (not shown) disposed within the rear of the handle 28 for axial movement. A cut off button 172, rigidly connected to one end of the rod, is disposed to extend outwardly from the handle 28. The other end of the rod, disposed within the handle 28, is spring biased to urge the rod toward the rear of the handle 28. The cut off boss 170 is disposed in a slot (not shown) in the bottom portion of the handle 28. In normal operation, the cut off boss 170 rests against an upstanding stop 174, rigidly attached to the housing 22, such that the handle 28 is relatively horizontal. The stop 174 limits further downward movement of the handle 28.

The cut off arm 30 is pivotally mounted to the housing 22 by way of a pin 176. A spring 178 biases the cut off arm 30 upwardly. A notch 180 formed in the top edge of the cut off arm 30, receives the cut off boss 170 when the pushbutton 172 is depressed. This allows the handle 28 to be rotated downwardly from the horizontal position. The additional rotation of the handle 28 causes the cut off arm 30 to rotate in a counterclockwise direction.

The cut off arm 30 is operatively coupled to a cut off blade 186. More particularly, the cut off arm 30 is provided with an extending protuberance 182 (FIGS. 12B and 13B), received in an aperture 184 in the cut off blade 186. In operation, when the cut off arm 30 is rotated this causes the cut off blade 186 to move upwardly to cut the band 18 extending outwardly from the slot 120 to allow the termination to be removed from the tool 20.

The cut off blade 186 is a U-shaped member having one leg provided with the aperture 182 and another leg with a blade portion 194. The blade portion 194 communicates with the slot 120 in the nose portion 26. A pair of spaced apart guide channels 188 are formed in the nose portion 26 of the tool 20. These guide channels 188 are formed with a notch (not shown) for receiving an extending lip (not shown) integrally formed on the cut off blade 186. The guide channels 188 and the lip form a dovetail connection.

Figure 14:
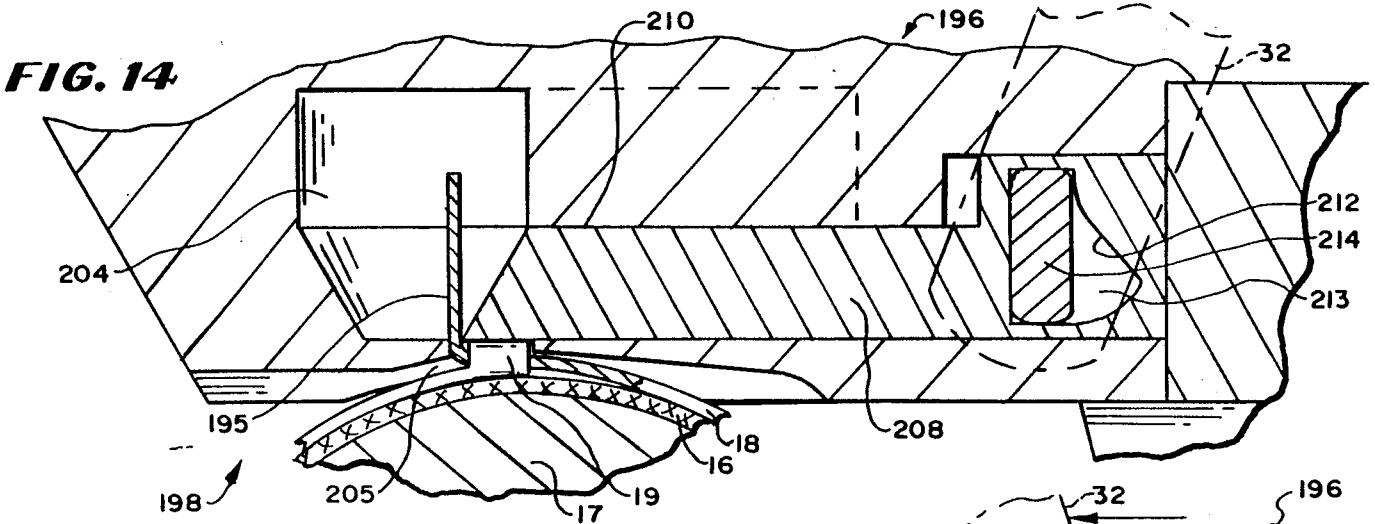
FIG. 14 is a partial sectional view of the bottom portion of the, tool illustrating the final trim assembly in its initial position.
Figure 15:
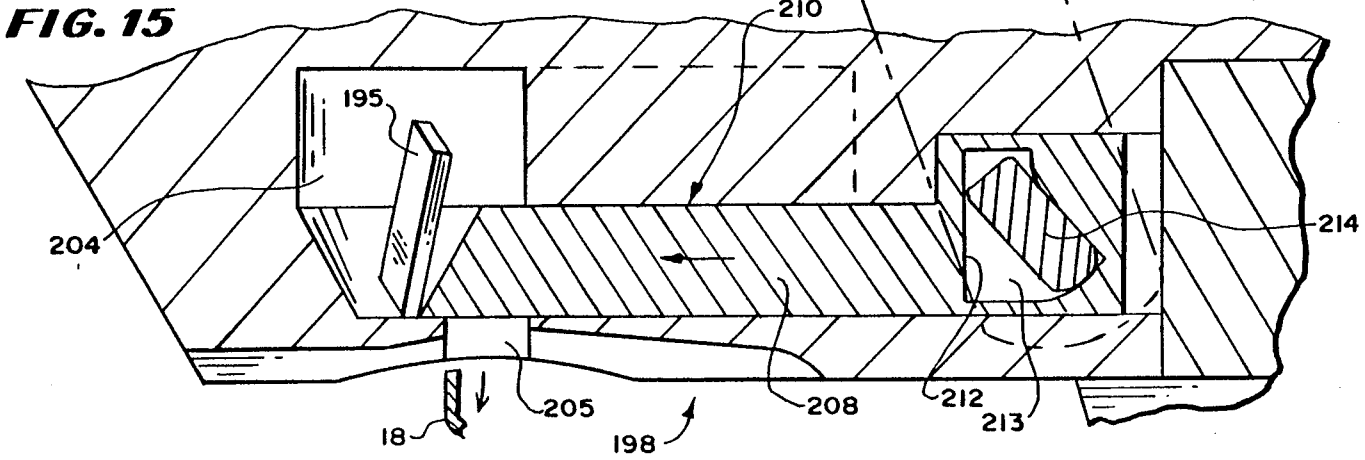
FIG. 15 is a partial sectional view similar to FIG. 14, illustrating the final trim assembly in its cut off position.

After the cutting operation is complete, an extending portion 195 (FIG. 14) of the band 18 extends outwardly from the buckle 19. This extending portion 195 of the band 18 is trimmed in a final cut off assembly 196. FIG. 14 illustrates the final trim assembly 196 in the normal position while FIG. 15 shows the position of the final trim assembly after the trim blade 208 has sheared off the excess portion of the band.

Figure 2:
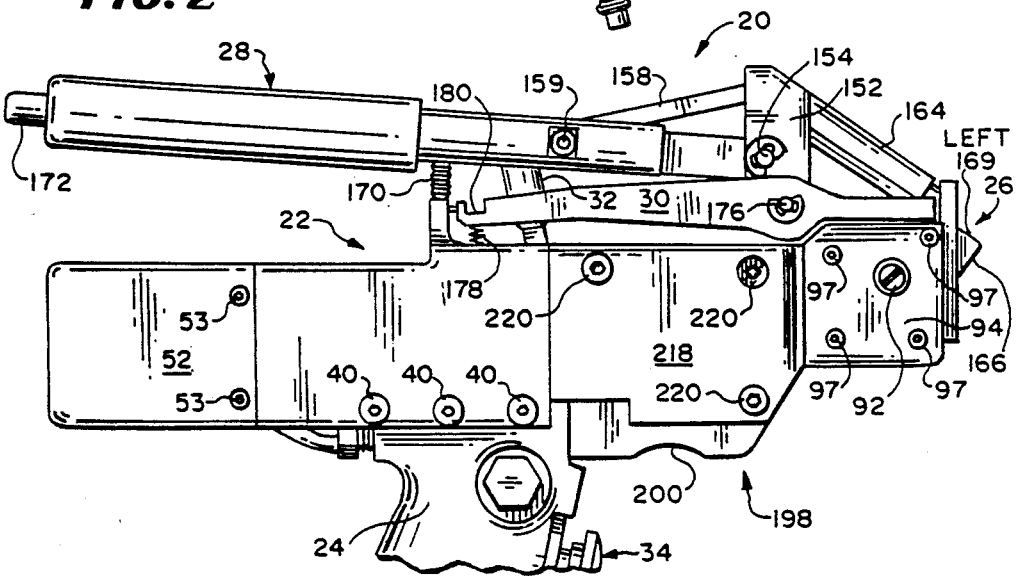
FIG. 2 is a partial left side elevational view of the tool illustrated in FIG. 1.
Figure 3:
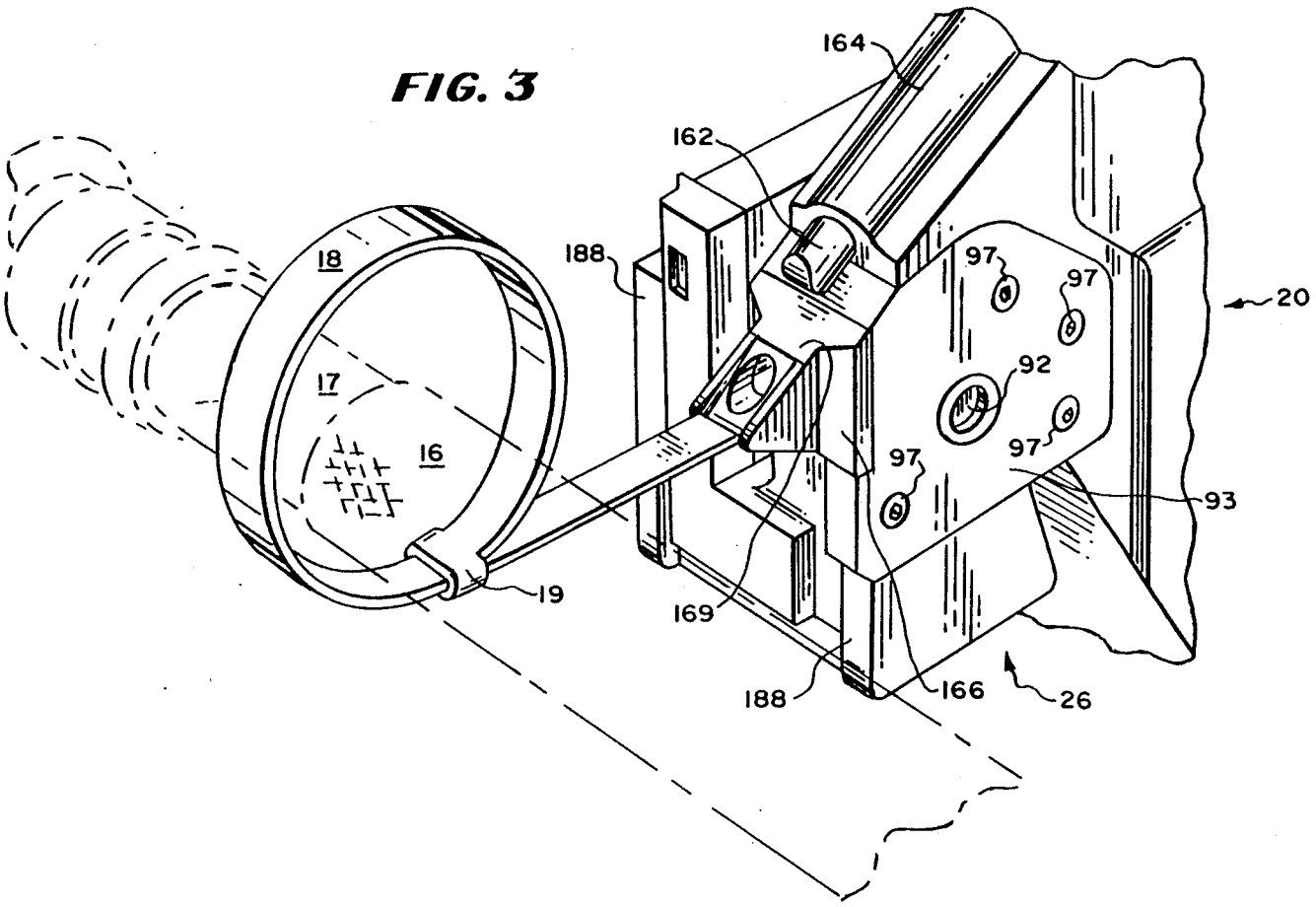
FIG. 3 is a partial perspective view of the tool in accordance with the present invention illustrating the nose portion of the tool.

The final trim assembly 196 is configured to properly orient the termination for a final trim operation. A notch 200 is formed in the chin portion 198 of the tool 198 to receive the termination. The termination is nested in the notch 200 such that the extending band portion 195 extends into a cut off receptacle 204 (FIGS. 14 and 15) integrally formed inside the tool housing 22 through a slot 205. A blade assembly 206 is movably mounted with respect to the slot 205 to shear the extending portion 195 of the band 18 from the termination. Once the extending portion 195 is cut, it is stored in the receptacle 204 until removal. These severed extending portions 195 of the band 18 can be removed by removing a side plate 218 connected to the housing 22 by way of fasteners 220 (see FIG. 2).

The blade assembly 206 includes a trim blade 208 mounted within a channel 210 formed in the interior of the chin portion 198. The one end of the trim blade 208 is formed with a cam surface 212 formed from an irregular shaped slot in the trim blade 208. A cam member 214 is received in the cam slot 212 and journalled (not shown) on the inside the tool housing 22. The other end of the cam member 214 extends outwardly from the side of the housing 22 and is formed with a square head 215.

A final trim lever 32 with a square aperture for receiving the square head 216 is disposed on the outside of the housing. The cut off lever 32 is secured to the housing by a plate 222. The interior surface of the plate 222 is formed with a channel (not shown) to allow pivotal movement of the cut off lever 32. The plate 222 is fastened to the housing by way of fasteners 224. In operation, rotation of the final trim lever 32 causes the trim blade 208 to move with respect to the slot 205 to cut the extending portion 195 of the band 18 and deposit it in the cut off receptacle 204.

In operation, a continuous web or a free end of a double loop of stainless steel band 18 is inserted into the tool 20 while the air trigger button 34 is held in depressed. The band 18 is then advanced through the tool by holding the trigger 34 depressed. The trigger 34 is held until the band 18 is tight around the connector housing 17 and the free end of the band 18 no longer advances through the tool 20. The trigger 34 is then released and the rollover handle 28 is lifted its full extent to bend the band 18 at the buckle 19 to secure the tension in the band 18. The rollover handle 28 is then returned to its original position and the button 172 is depressed to allow the cut off boss 170 to be received in the notch 180 in the cut off arm 30. By depressing the handle 28 past the horizontal position, the cut off arm 30 actuates the cut off blade 196 in the nose portion 26 of the tool 20 thereby raising the blade 196 to shear the band 18 and allow the completed termination to be removed. The free end of the band 18 may be removed from the tool by depressing the trigger 34 and running the tool 20 until the free end is released from the gripping mechanism and the band end falls from the tool 20. The termination is then rotated placing the buckle 19 in a vertical oriented position. The termination is then placed under the chin portion 198 of the tool inserting the extending portion 195 of the band 18 into the final trim blade assembly 208. The buckle 19 of the band 18 should nest in the recess provided in the blade housing to properly orient the termination for a final trim operation. By rotating the trim blade lever 32 forward to its full extent of travel, the extending portion 195 will be trimmed providing a low profile termination. The trimmed off portion of the band 18 is contained within a receptacle 204 the tool and is removed by unscrewing the side plate 218 and exposing the receptacle 204.

Obviously many modifications and variations of the present invention are possible in light of the above teachings such as utilizing an electric motor or other means of motive power. Thus, it is to be understood that, within the scope of the appended claims, the invention may be practiced otherwise than as specifically described hereinabove.

What is claimed and desired to be secured by Letters Patent of the United States is:

1. A banding tool for terminating a band with a buckle to a sleeve comprising:

a housing;

a drive track disposed within said housing;

means for gripping the band disposed adjacent the drive track; and means including a clutch engaged in a forward direction and a reverse direction which cooperates with said gripping means for progressively advancing the band in either a forward direction or a reverse direction in the drive track at a predetermined pull pressure to tighten or loosen the band around the sleeve including a reversible rotary drive mechanism, means for adjusting said predetermined pull pressure and a source of motive power.

2. A banding tool as recited in claim 1, wherein said advancing means includes a pneumatic motor and means for receiving an external source of compressed air.

3. A banding tool as recited in claim 2, wherein said pneumatic motor is reversible.

4. A banding tool as recited in claim 1, further including means for adjusting the pull pressure of the advancing means.

5. A banding tool as recited in claim 1, further including a worm gear assembly operatively coupled to said source of motive power.

6. A banding tool as recited in claim 1, wherein said gripping means includes a knurled wheel and a plurality of pinch rollers spaced therefrom adjacent the drive track.

7. A banding tool as recited in claim 6, wherein said pinch rollers are biased toward said knurled wheel.

8. A banding tool for terminating a band with a buckle to a sleeve comprising:

a housing;

a drive track disposed within said housing;

means for gripping the band disposed adjacent the drive track;

means in cooperation with said gripping means for advancing the band in the drive track; and means for bending the band about the buckle including a member slidably mounted for rectilinear movement about an axis at an acute angle with respect to the drive track to secure the tension in the band after the band is tightened around the sleeve.

9. A banding tool as recited in claim 8, further including means for cutting the band at a predetermined distance from the buckle defining an extending portion after the band is bent about the buckle to allow the termination to be removed from the tool.

10. A banding tool for terminating a band with a buckle to a sleeve comprising;

a housing;

a drive track disposed within said housing;

means for gripping the band disposed adjacent the drive track;

means in cooperation with said gripping means for advancing the band in the drive track at a predetermined pull pressure to tighten the band around the sleeve including a source of motive power;

means for cutting the band at a predetermined distance from the buckle defining an extending portion after the band is bent about the buckle to allow the termination to be removed from the tool; and means for cutting the extending portion.

11. A banding tool for terminating an electromagnetic shielding sleeve used to shield electrical conductors from the electromagnetic and radio frequency interference to an electrical cable connector housing or the like comprising:

a housing;

a drive track within said housing;

means for gripping the band disposed adjacent the drive track;

means including a reversible rotary drive mechanism for progressively advancing the band in either a forward direction or a reverse direction in the drive track at a predetermined pull pressure including a clutch engaged in both the forward direction and the reverse direction; and adjustment means for adjusting said predetermined pull pressure.

12. A banding tool as recited in claim 11, wherein said advancing means includes a source of motive power.

13. A banding tool as recited in claim 12, wherein said source of motive power is provided by a pneumatic motor.

14. A banding tool as recited in claim 12, wherein said source of motive power is provided by an electric motor.

15. A banding tool as recited in claim 13, wherein said advancing means further includes a worm gear assembly having an input shaft, operatively coupled to said pneumatic motor, and an output shaft.

16. A banding tool as recited in claim 15, wherein said adjusting means is disposed adjacent the output shaft of said worm gear assembly.

17. A banding tool as recited in claim 15, wherein said adjustment means includes an adjustable clutch.

18. A banding tool as recited in claim 17, wherein said adjustable clutch includes a pair of pressure plates disposed about the worm gear assembly output shaft, each pressure plate having an engaging surface disposed adjacent a side of said worm gear.

19. A banding tool as recited in claim 18, wherein said pressure plates are rigidly coupled to said worm gear assembly output shaft.

20. A banding tool as recited in claim 19, wherein said engaging surfaces are provided with a friction material.

21. A banding tool as recited in claim 20, wherein said output shaft includes a threaded portion adjacent one end.

22. A banding tool as recited in claim 21, further including an adjustment nut received by said threaded portion.

23. A banding tool as recited in claim 22, further including biasing means disposed between said adjustment nut and one of said pressure plates.

24. A banding tool as recited in claim 11, further including a knurled wheel operatively coupled to said advancing means and a plurality of pinch roller assemblies spaced apart from said knurled wheel and disposed adjacent said drive track.

25. A banding tool as recited in claim 24, wherein said pinch roller assemblies include means for biasing said pinch rollers toward said knurled wheel.

26. A banding tool as recited in claim 25, wherein said biasing means includes one or more Belleville washers.

27. A banding tool as recited in claim 24, wherein said pinch roller assemblies are disposed concentrically with respect to said knurled wheel.

28. A banding tool as recited in claim 24, wherein said pinch roller assemblies include:

a cylindrical roller;

a generally rectangular member having a concave surface for capturing said cylindrical roller and a bearing surface disposed opposite said concave surface; and biasing means disposed adjacent said bearing surface.

29. A banding tool as recited in claim 24, wherein said plurality is three.

30. A banding tool for terminating a band with a buckle to a sleeve comprising:

a housing;

a drive track;

a nosepiece portion coupled to said housing having a slot for receiving the band and forming a guide;

means for gripping the band;

means in cooperation with said gripping means for advancing the band in the driven track at a predetermined pull pressure to tighten the band around the sleeve; and means for bending the band about the buckle including a rollover member, reciprocally mounted for rectilinear movement along an axis at an acute angle with respect to said drive track to secure the tension in the band after the band is tightened around the sleeve.

31. A banding tool as recited in claim 30, wherein said banding means includes a handle pivotally connected to the housing at one end and pivotally connected at the other end to a rod disposed in a guide chamber formed as part of the housing, adjacent the nosepiece portion.

32. A banding tool as recited in claim 31, wherein said advancing means includes a source of motive power.

33. A banding tool as recited in claim 30, wherein said advancing means includes means for progressively advancing the band through the drive track.

34. A banding tool as recited in claim 30, further including means for cutting said band to allow the termination to be removed from the tool.

35. A banding tool as recited in claim 34, wherein said cutting means includes a blade movably disposed with respect to the drive track and operatively coupled to a lever pivotally connected to said housing.

36. A banding tool as recited in claim 35, wherein said blade is disposed adjacent said nosepiece portion.

37. A banding tool for terminating a band with a buckle to a sleeve comprising:

a housing;

a drive track;

a nosepiece coupled to said housing having a slot for receiving the band;

means for gripping the band;

means in cooperation with said gripping means for advancing the band in the drive track at a predetermined pull pressure to tighten the band around the sleeve;

means for bending the band about the buckle to secure the tension in the band after the band is tightened around the sleeve;

means for cutting said band to allow the termination to be removed from the tool; wherein said cutting means includes a blade movably disposed with respect to the drive track and operatively coupled to a lever pivotally connected to said housing, said blade disposed adjacent said nosepiece portion, and means for trimming a portion of the band which extends outwardly from the buckle after the band is cut.

38. A banding tool as recited in claim 37, wherein said trimming means includes a trim blade operatively coupled to a trim lever pivotally connected to said housing.

39. A banding tool as recited in claim 38, wherein said trimming means is disposed adjacent a chin portion of said housing.

40. A banding tool as recited in claim 39, wherein said chin portion of said housing is provided with an arcuate notch for allowing the termination to be nested therewithin.

41. A banding tool as recited in claim 40, wherein said housing is provided with a receptacle for receiving said extending portions of said bands.

42. A banding tool as recited in claim 41, wherein said receptacle is disposed adjacent said notch.

43. A banding tool as recited in claim 42, further including a removable plate fastened to said housing adjacent said receptacle.

44. A banding tool as recited in claim 43, wherein said advancing means includes a source of motive power.

45. A banding tool as recited in claim 44, wherein said source of motive power is provided by a pneumatic motor.

46. A banding tool as recited in claim 45, wherein said pneumatic motor is reversible.

47. A banding tool as recited in claim 46, further including means for adjusting the pull pressure of the advancing means.

48. A banding tool as recited in claim 47, wherein said advancing means includes an adjustable clutch.

49. A banding tool as recited in claim 44 wherein said source of motive power is provided by an electric motor.

50. A banding tool as recited in claim 45, wherein said advancing means includes means for progressively advancing the band through said drive track.

* * * * *